US005177910A

United States Patent [19]

Norota et al.

[11] Patent Number: 5,177,910

[45] Date of Patent: Jan. 12, 1993

[54] STRIATED FLEXIBLE SHEET MATERIAL FOR BRUSH AND BRUSH STRUCTURE THEREOF

[75] Inventors: Susumu Norota; Hiroyuki Adachi, both of Ibaraki, Japan

[73] Assignee: Teijin Limited, Osaka, Japan

[21] Appl. No.: 582,496

[22] Filed: Sep. 14, 1990

[30] Foreign Application Priority Data

Sep. 28, 1989 [JP] Japan ..... 1-250565

[51] Int. Cl.[5] ..... B24D 11/00

[52] U.S. Cl. ..... 51/394; 51/395; 51/397; 51/398; 51/295

[58] Field of Search ..... 51/403, 330, 331, 358, 51/360, 392, 394, 395, 397, 334, 332, 295, 297, 398; 15/180, 159, 162, 164, 207

[56] References Cited

U.S. PATENT DOCUMENTS

| | | | |
|---|---|---|---|
| 2,001,911 | 5/1935 | Wooddell et al. | 51/397 |
| 2,115,897 | 5/1938 | Wooddell et al. . | |
| 2,292,261 | 8/1942 | Albertson | 51/395 |
| 2,907,146 | 10/1959 | Dyar | 51/397 |
| 3,043,064 | 7/1962 | Paterson | 51/397 |
| 3,090,061 | 5/1963 | Charvat | 15/159 R |
| 3,141,269 | 7/1964 | Block | 51/337 |
| 3,196,586 | 7/1965 | Brown et al. | 51/394 |
| 3,212,219 | 10/1965 | Gillett | 51/337 |
| 3,498,010 | 3/1970 | Hagihara | 51/395 |
| 4,104,756 | 8/1978 | Gasser et al. | 51/334 |
| 4,111,666 | 9/1978 | Kalbow | 51/395 |
| 4,142,870 | 3/1979 | Lovejoy | 51/298 |
| 4,285,171 | 8/1981 | Block et al. | 51/337 |
| 4,364,985 | 12/1982 | Tokuyama et al. | 51/281 R |
| 4,682,446 | 7/1987 | Woodall et al. | 51/395 |
| 4,707,950 | 11/1987 | Kawasaki | 51/358 |

FOREIGN PATENT DOCUMENTS

| | | |
|---|---|---|
| 333570 | 12/1976 | Austria . |
| 2107454 | 2/1971 | Fed. Rep. of Germany . |
| 2452589 | 11/1974 | Fed. Rep. of Germany . |
| 759644 | 4/1954 | United Kingdom . |

OTHER PUBLICATIONS

Fachberichte Huttenpraxis Metallweiterverbeitung, vol. 15, Feb. 19, 1977.

*Primary Examiner*—M. Rachuba
*Attorney, Agent, or Firm*—Burgess, Ryan & Wayne

[57] ABSTRACT

A brush structure comprising a plurality of striated flexible synthetic polymer sheets provided with a plurality of striae and ridges formed alternately on one or two faces of the sheet and extending in parallel to each other and to the longitudinal axis of the sheet, the striated sheets being bonded at longitudinal one end portions thereof to one another to thereby form a block or bundle of the striated sheet.

9 Claims, 3 Drawing Sheets

STRIATED FLEXIBLE SHEET MATERIAL FOR BRUSH AND BRUSH STRUCTURE THEREOF

BACKGROUND OF THE INVENTION

1) Field of the Invention

The present invention relates to a striated flexible sheet material for a brush, and a brush material thereof. More particularly, the present invention relates to a striated flexible polymeric sheet material useful for forming a brush for washing or polishing a surface of a hard material, for example, a steel strip, and a brush structure made from the same.

2) Description of the Related Arts example, a steel strip is washed or polished by using a brush in which a number of rigid, flexible synthetic polymeric hairs, for example, nylon 66 hairs, are fixed on a disc-shaped or cylinder-shaped base member, or an abrasive device in which a sand or emery paper sheet or an abrasive nonwoven fabric is fixed on a disc-shaped or cylinder-shaped base member. Such a brush or abrasive device is useful for effectively and easily washing or polishing the steel strip surface.

Nevertheless, the conventional rigid, flexible hair-type brush is disadvantageous in that undesirable brush marks are formed on the brushed surface, the polishing effect is unsatisfactory, and the gaps between the hairs are easily filled with dust. Also, the sand or emery paper sheet is disadvantageous in that the durability of the abrasive effect thereof is poor because the abrasive particles are easy removed from the base paper sheet, the surface to be polished is rapidly abraded, and the washing (cleaning) effect is unsatisfactory. Furthermore, the abrasive nonwoven fabric is disadvantageous in that the surface to be polished is rapidly abraded, the pores in the fabric are easily blocked by dust, and fine fibrils are generated and removed therefrom.

SUMMARY OF THE INVENTION

An object of the present invention is to provide a striated flexible sheet material useful for a brush having a strong cleaning effect, a high abrasive resistance, and free from the disadvantage that the gaps between brushing hairs are easily blocked with dust, and a brush structure comprising the same.

Another object of the present invention is to provide a striated flexible sheet material applicable to various forms of brushes, and a brush structure comprising the same.

Still another object of the present invention is to provide a striated flexible sheet material useful for a brush having a high heat resistance and high durability, and a brush structure comprising the same.

A further object of the present invention is to provide a striated flexible sheet material useful for a brush capable of uniformly cleaning and polishing a surface of a hard material, and a brush structure comprising the same.

The above-mentioned objects can be attained by the striated flexible sheet material of the present invention, which is useful for a brush, and comprises a flexible synthetic polymer and is provided with a plurality of striae and ridges formed alternately on at least one face of the sheet and extending in parallel to each other along the longitudinal axis of the sheet.

The brush structure of the present invention also comprises a plurality of striated flexible sheets comprising a flexible synthetic polymer and having a plurality of striae and ridges formed alternately on at least one face of the sheet and extending in parallel to each other along the longitudinal axis of the sheet, the striated sheets being arranged in the same direction with respect to the extending direction of the striae and the ridges, are being superposed on each other and bonded to each other at longitudinal one end portions thereof with a bonding material, to provide a block or bundle of the striated sheets.

DESCRIPTION OF THE PREFERRED EMBODIMENTS

Figure 1:
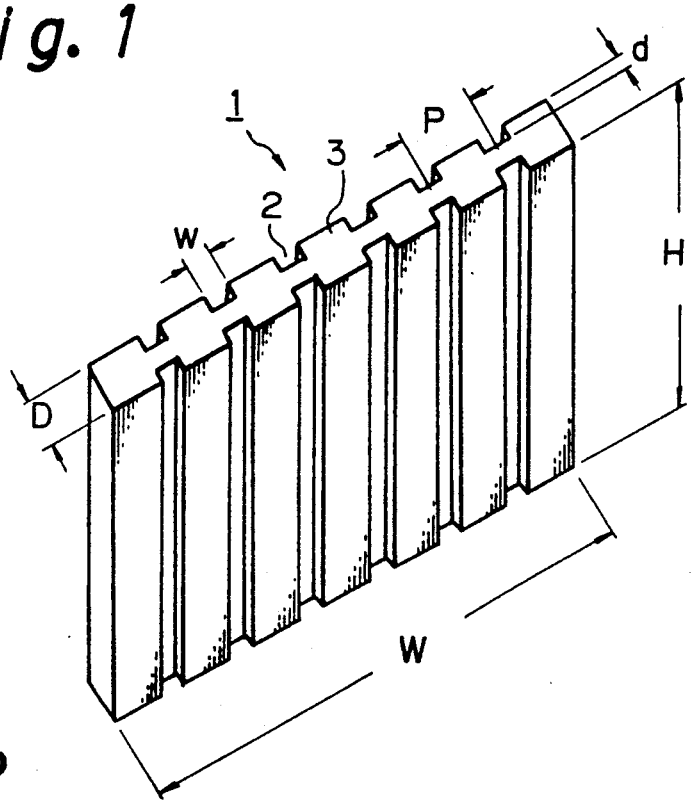
FIG. 1 shows a perspective view of an embodiment of the striated flexible sheet material of the present invention useful for a brush.

A perspective view of a preferable embodiment of the striated flexible sheet material of the present invention is illustrated in FIG. 1.

In FIG. 1, a flexible polymeric sheet 1 is provided with a plurality of striae 2 and ridges 3 which are alternately formed on the two faces of the sheet 1 and extend in parallel to each other and to the longitudinal direction of the sheet 1.

Preferably, the striated flexible sheet 1 has a length H of 10 to 200 mm, and a width $\overline{W}$ of 10 to 200 mm. The length H is taken in the longitudinal direction of the sheet 1 and the width W is taken in the transversal direction of the sheet 1. The length of the sheet is variable depending on the trim of the brush structure to be produced from the sheet.

Also, the maximum thickness D of the sheet 1 is preferably from 0.1 to 5 mm.

The depth d of the striae 2 preferably corresponds to 0.5% to 90%, more preferably 20% to 60%, of the maximum thickness D of the sheet 1.

Also, the striae 2 preferably have a width W of from 0.05 to 10 mm, more preferably 0.2 to 5 mm and are arranged at intervals P of from 0.2 to 50 mm, more preferably 0.5 to 20 mm.

In the preferable striated sheet 1 indicated in FIG. 1, the striae 2 and ridges 3 are formed on the two faces of the sheet 1 and symmetrically about a center plane of the sheet 1. The striae 2 and ridges 3 can be formed asymmetrically about the center plane of the sheet Also the striae 2 and ridges 3 can be formed on one face of the sheet 1. The width and intervals of the striae 2 may be constant, as shown in FIG. 1, or variable.

When a plurality of the striated flexible sheets are arranged in parallel to each other on a base member or radially around a center of the base member, sometimes the locations of the ridges, of the arranged sheets are preferably randomized but do not overlap in the direction of brushing, to ensure an even brushing.

In the striated flexible sheet material of the present invention, the flexible synthetic polymeric sheet preferably comprises, as a principal matrix, at least one thermoplastic polymer selected from the group consisting of polyolefin resins, for example, polyethylene and polypropylene resins; aliphatic polyamide resins, for example, nylon 6 and nylon 66 resins, aromatic polyamide resins, for example, aromatic metha-polyamides such as poly-m-phenylene isophthalamide (PMIA) resins; polyester resins, for example, polyethylene terephthalate and polybutylene terephthalate resins; and other heat resistant organic polymers, for example, polysulfone polyethersulfone, polyetheretherketone, polyphenylenesulfide, polyallylate and fluorine-containing polymer resins.

The most preferable polymeric materials for the present invention are high heat-resistant resins comprising, as a principal component, an aromatic methaaramide resin, for example, poly-m-phenylene isophthalamide (PMIA) resins.

Since the above-mentioned PMIA resins have a high melting point of about 420° C., the resultant striated sheets exhibit a high resistance to melting even when a frictional heat is generated in the sheets due to brushing.

Also, since the PMIA resins have a high glass transition temperature of 275° C., the resultant striated sheets exhibit a high resistance to a reduction of the modulus of elasticity thereof, even when a heat build-up occurs in the sheets due to brushing.

Also, the striated sheet made from the PMIA resin exhibits a high modulus of elasticity and resilience, and an excellent abrasion resistance, which are indispensable properties for a brush-forming material.

Furthermore, the PMIA resin striated sheet of the present invention can be produced by a melt-extrusion method without a thermal decomposition of the resin.

In the conventional shaping technique for the aromatic polyamide resins, it is believed that the application of the melt-extrusion process to the conventional aromatic polyamide resins cannot be successful because the melting point and the thermal decomposition point of the resins are very close to each other, and thus the melt-extrusion procedure at a temperature higher than the melting point of the resins results in a thermal decomposition of the resins.

Nevertheless, as disclosed in Japanese Unexamined Patent Publication Nos. 63-12713 and 63-21920 to the same inventors as those of the present invention, it is possible to produce shaped articles, for example, flat threads, from the PMIA resin containing abrasive particles by the melt-extrusion method, and accordingly, the striated sheet material of the present invention can be produced from the PMIA resin by the melt-extrusion method.

The striated sheet material of the present invention optionally contains abrasive particles therein, and this abrasive particle-containing striated sheet material is useful for producing an abrasive brush.

The method of incorporating the abrasive particles to the striated sheet material is not limited to a specific method, as long as the abrasive particles can be evenly distributed in at least a portion, (for example, a brushing edge portion) of the striated sheet material. The abrasive particles preferably have a size of 0.1 to 1000 μm and are selected from heat-resistant abrasive particles, for example, silicon carbide, alumina, diamond, emery, cerium oxide, magnetite and metal particles. Usually, the abrasive particles are dispersed in at least a portion of the striated sheet material at a distribution density oi 0.01 to 0.9 g/cm$^3$.

Figure 6:
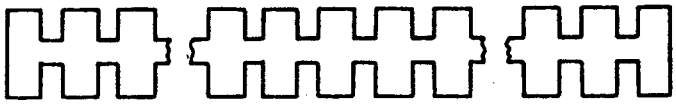
FIG. 6 is a cross-sectional profile of an embodiment of the melt-extrusion slit for producing the striated flexible sheet material of the present invention; and, FIG. 7 is a photograph of a longitudinal edge portion of an embodiment of the striated flexible sheet material of the present invention.

The striated sheet of the present invention can be produced by melt extruding a thermoplastic polymeric resin optionally containing abrasive particles through an extruding slit having a plurality of striae and ridges, as shown in FIG. 6, and cooling and cutting the resultant striated sheet to the desired dimensions.

The brush structure of the present invention comprises a base member and a plurality of striated flexible synthetic polymeric sheets of the present invention each provided with a plurality of striae and ridges formed alternately on at least one face of the sheet and extending in parallel to each other along the longitudinal axis of the sheet. The plurality of striated sheets are fixed at longitudinal one end portions thereof to one another, to thereby form at least one bundle or block of the striated sheets.

Figure 2:
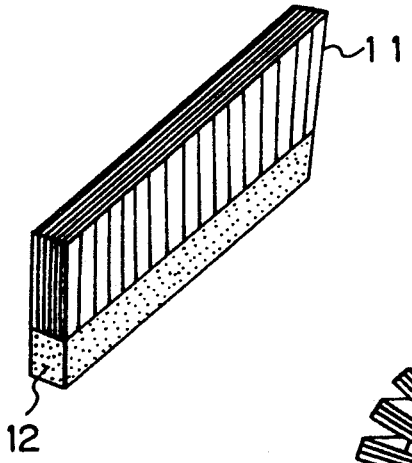
FIG. 2 shows a perspective view of an embodiment of the brush member of the present invention.

Referring to FIG. 2, showing a perspective view of an embodiment of the brushing structure of the present invention, a plurality of the striated sheets 11 are arranged in parallel to each other in the longitudinal direction thereof, and are superposed one on the other. The longitudinal end portions of the striated sheets 11 are bonded to each other through a bonding material 12, to thereby provide a block or bundle of the striated sheets.

In the production of the striated sheet block or bundle as shown in FIG. 2, a bonding material is applied to one longitudinal end portion of each of a plurality of striated sheets, then the plurality of striated sheets are superposed one on the other in the above-mentioned arrangement so that they are bonded to each other at the longitudinal end portions thereof, and the resultant block or bundle of the striated sheets is bonded to a base member. Alternatively, the plurality of striated sheets are superposed one on the other in the above-mentioned arrangement manner, then a bonding material liquid having a high penetration property is applied to a longitudinal end portion of the resultant block, to allow the bonding material liquid to penetrate the gaps between the striated sheets, and then the block or bundle of the striated sheets is fixed to a base member.

The bonding material is not restricted to a specific material, but is preferably selected from high heat-resistant bonding materials, for example, epoxy and silicone rubber bonding materials.

In the brush structure of the present invention, a plurality of the striated sheets may be radially arranged on a curved surface of a base member.

Figure 3:
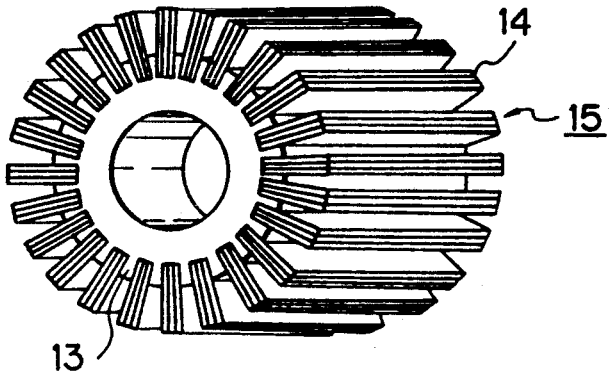
FIG. 3 shows a perspective view of another embodiment brush structure of the present invention.

Referring to FIG. 3, a base member 13 is in the form of a cylinder or ring, and a plurality of striated sheets 14 are transversely arranged along the longitudinal axis of the cylindrical base member, on the periphery of the cylindrical base member, and longitudinally extended outwardly from the periphery of the cylindrical base member in the radial direction thereof.

Each of the longitudinal one end portions of the striated sheets 14 is fixed to the periphery of the cylindrical base member 13 by a bonding material. In another embodiment, the cylindrical base member 13 is provided with a plurality of grooves formed in the peripheral portion thereof, and the striated sheets 14 are bonded to the grooves of the cylindrical base member 13.

In still another embodiment, a plurality of striated sheets are superposed one on the other, to provide a plurality of blocks 15 as shown in FIG. 3, and the blocks 15 are longitudinally and transversely arranged on the periphery of the cylindrical base member 13 in the same manner as mentioned above, and as shown in FIG. 3.

The longitudinal end portions of the blocks can be fixed in grooves formed in the periphery of the cylindrical base member.

Figure 4:
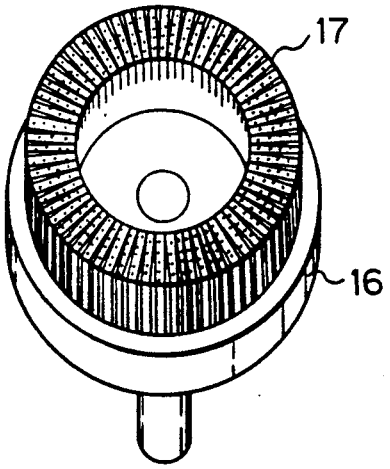
FIG. 4 shows a perspective view of still another embodiment of the brush structure of the present invention.

Referring to FIG. 4, showing another embodiment of the brush structure of the present invention, a base member 16 is in the form of a circular or annular disk and a plurality of striated sheets 17 are transversely arranged on the base member, in the radial direction around the center of the circular or annular base member.

Figure 5:
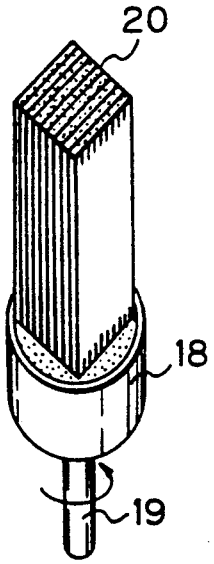
FIG. 5 shows a perspective view of a further embodiment of the brush structure of the present invention.

In still another embodiment of the brush structure of the present invention as shown in FIG. 5, a base member 18 is in the form of a circular disk and is rotatable about a shaft 19 connected thereto, and a plurality of striated sheets are superposed one on the other, and the resultant block 20 is fixed at a longitudinal end portion thereof to the base member 18.

The striated sheet material and the brush structure of the present invention have the following advantages.

1) When a plurality of striated sheets are superposed one on the other, and the resultant blocks are bonded to a base member with a bonding material to provide a brush structure, the bonding material easily penetrates the gaps between the striated sheet through the striae of the sheets.

2) The striated sheets can be firmly bonded to each other and to the base member, by the bonded material penetrating the striae.

3) In the striated sheets in the brush member, the ridge portions are connected to each other through the striae portions and serve as brushing hairs.

In brushing operation, the conventional brushing hairs, which are separate from each other, can move laterally with respect to the brushing direction, and this lateral movement of the brushing hairs results in a reduced and uneven brushing effect.

Nevertheless, since the ridge portions are connected to each other through the striae portions, the ridge portions cannot move laterally with respect to the brushing direction, and thus the resultant brushing effect is high and even.

4) When an excessively large force is applied to the striated sheets in the brushing structure, the force can be absorbed by rupturing the striae portions without breaking the ridge portions. Therefore, the brush member has a long durability and does not contain pieces broken from the ridge portions.

EXAMPLES

Example 1

A PMIA resin was melt extruded through an extrusion slit having the cross-sectional profile as indicated in FIG. 6, in accordance with the melt-extrusion method and apparatus disclosed in Japanese Unexamined Patent Publication No. 63-12713, and the resultant striated sheet was drawn at a draw ratio of 2.5 on a heating plate at a temperature of 290° C. The drawn striated sheet having a width of 70 mm was then transversely cut to a length of 40 mm.

Figure 7:
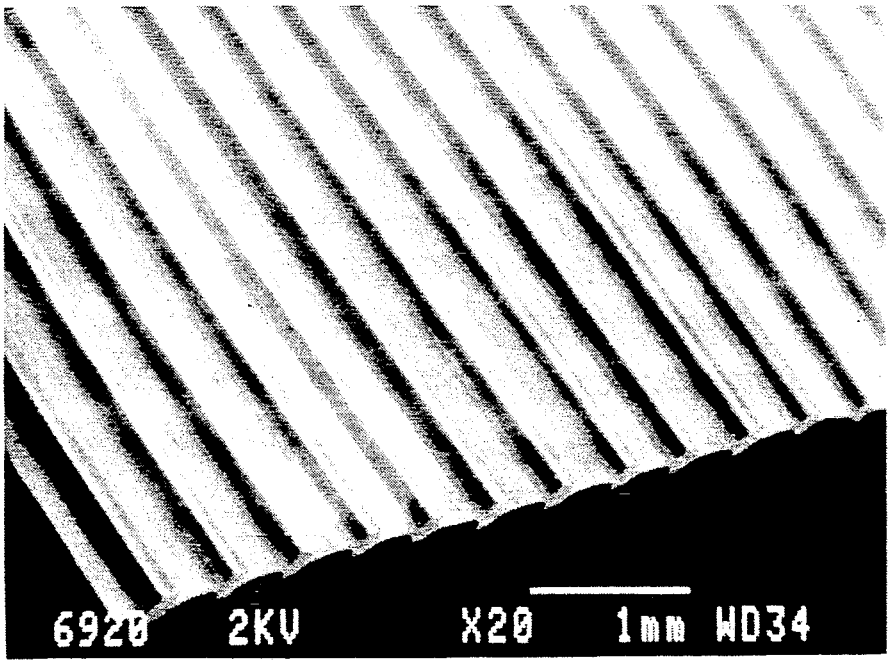

FIG. 7 is a magnified photograph of an edge portion of the resultant striated sheet.

The dimensions of the striated sheet were as follows.

| | |
|---|---|
| Width ($\overline{W}$): | 70 mm |
| Length (H): | 40 mm |
| Maximum thickness (D): | 0.6 mm |
| Depth of striae (d): | 0.25 mm |
| Width of striae (w): | 0.5 mm |
| Interval of striae (p): | 0.8 mm |

A brush structure as shown in FIG. 2 was produced from the above-mentioned striated sheets, in the following manner.

A Silicone rubber adhesive (trademark: Silicone RUBBER ADHESIVE KE44W, made by Shinetsu Kagaku K. K.) was applied to a longitudinal end portion having a length of about 10 mm, of each of 17 pieces of the striated sheets, then the striated sheets were superposed on and bonded to each other to provide a block or bundle having a total thickness of 14 mm. In this block, all of the striae and ridges of the striated sheets are extended in parallel to each other.

A brush roll as shown in FIG. 3 was prepared from a plurality of the above-mentioned striated sheet blocks in the following manner.

A cylindrical base member had a length of 1400 mm and an outside diameter of 225 mm, and was provided with 36 grooves formed in the periphery of the base member at regular intervals; each groove having a width of 14 mm and depth of 12 mm and extending along the longitudinal axis of the cylindrical base member.

The same silicone rubber adhesive as mentioned above was applied to the inside faces of the grooves and the striated sheet blocks were inserted to and bonded in the grooves of the cylindrical base member thereto.

The plurality of striated sheet blocks were separated from each other on the periphery of the cylindrical base member.

The resultant brush roll was used to clean a surface of a steel strip, to remove iron dust and grease thereon, and the brushing effect was evaluated in comparison with a conventional brush roll having a number of nylon 66 hard hairs, as follows:

1) The cleaning effect of the striated sheet brush roll appeared to be about twice that of the conventional nylon 66 hard hair brush roll, for the following reasons:

(i) When the striated sheet brush roll was used, the durability during use of a cleaning liquid became twice that when the conventional nylon 66 hair brush roll is used.

(ii) When the striated sheet brush roll was employed, the glossiness of the cleaned steel strip surface was similar to that obtained by using two nylon 66 hair brushes.

2) The necessary current of a motor for driving the striated sheet brush roll was about one half of that needed for the conventional nylon 66 brush, and the brushing effect of the striated sheet brush roll was satisfactory.

3) The use durability of the striated sheet brush roll was about 1.5 times that of the conventional nylon 66 hair brush roll. From this it was assumed that, when the conventional hair brush was used, the top end portions of the hair are worn and peter out during the brushing operation, whereas the striated sheets have a high abrasion resistance and thus do not peter out.

4) When the striated sheets are produced from a high heat-resistant polymeric resin, for example, PMIA, the cooling of the inside portion of the brush is unnecessary, and thus the control of the brushing operation is easy.

5) No brush marks were formed on the brushed surface when the striated sheet brush roll was used, whereas the conventional nylon 66 hair brush roll created several brush marks on the brushed surface. This is because the ridge portions of the striated sheet brush roll are able to uniformly rotate around a rotation shaft.

Example 2

A PMIA resin was mixed with silicon carbide abrasive particles (SiC #80) in an amount of 35% based on the weight of the resin, the mixed resin was melt-extruded through an extrusion slit having the cross-sectional profile as shown in FIG. 6, in accordance with the melt-extrusion method as disclosed in Japanese Unexamined Patent Publication No. 63-21920, and the resultant striated sheet was drawn at a draw ratio of 2.2 on a heating plate at a temperature of 290° C.

The resultant drawn striated sheet having a width of about 60 mm, was cut to a length of 50 mm.

The resultant cut striated sheets had the following dimensions

| | |
|---|---|
| Width ($\overline{W}$): | 60 mm |
| Length (H): | 50 mm |
| Maximum thickness (D): | 1.5 mm |
| Depth of striae (d): | 0.5 mm |
| Width of striae (w): | 0.7 mm |
| Interval of striae (p): | 1.0 mm |

A number of the striated sheets were arranged in the form of a ring, as shown in FIG. 4, and bonded at the longitudinal one end portions thereof to each other, in the following manner.

The longitudinal one end portions of the striated sheets were coated with an epoxy bonding material comprising 100 parts by weight of a bonding agent consisting of 50% by weight of an epoxy bonding agent (available under the trademark of EPICOAT 827 from Yuka Shell Epoxy K. K.) and 50% by weight of another epoxy bonding agent (available under the trademark of Epicoat 871 from Yuka Shell Epoxy K. K.) and 50 parts by weight of a curing agent (available under the trademark of EPICURE 3080, from Yuka Shell Epoxy K. K.); and the coated striated sheets were radially arranged in a ring-shaped mold and bonded to each other. The bonded striated sheet in the form of a ring was placed in a curing oven and cured at a temperature of 80° C. for 4 hours. The resultant cured striated sheet block was in the form of a ring with an outside diameter of 300 mm.

The ring-shaped block was bonded to a disk shaped base member having a flange and rotatable about a center thereof, and were fixed by the flange, as shown in FIG. 4.

A stainless steel strip surface was continuously brushed by the above-mentioned brush ring at a rotating number of 1200 rpm at a speed of the steel strip of 30 m/min, and after 3 passes, the amount of abrasion of the stainless steel strip was 60 g/m$^2$ and the surface roughness of the brushed surface was 0.8 $\mu$m.

Accordingly, the brush ring was satisfactory when used as a heavy abrasive brush and as a high scratch processing brush.

The brush structure of the present invention is advantageous in the following points.

1) The brush structure of the present invention is provided with all necessary properties for a brushing action.

2) In the brush structure, the striated sheets can be easily bundled and firmly bonded to each other, due to a plurality of striae and ridges.

3) A flat top brushing face of the brushing structure can be easily prepared without cutting hairs.

4) The resultant brush has a satisfactory brushing effect derived from the movement of the top end portions of the striated sheets in the brushing direction, and is free from an undesirable lateral movement of the top end portions of the striated sheets, whereas the conventional brush hairs are easily bent in the lateral direction.

5) The striated sheets have a larger flexural rigidity than that of conventional brush hairs, and thus exhibit a high brushing effect.

6) In the case of a rotatable brush, no brushing marks are formed on a brushed face, because the striated sheets are evenly distributed around a rotating shaft, whereas in the conventional rotatable hair brush, the distribution of hairs around the rotating shaft is not even, and thus brushing marks are often formed on the brushed surface.

7) Even in the rotatable disk brush, the striated sheets are not detached due to a centrifugal force applied thereto when rotated, whereas the hairs in the conventional hair disk brush are easily detached by the centrifugal force.

8) In the abrasive particle-containing striated sheet brush structure, since the abrasive particles are held within a resinous matrix of the striated sheets, the brush structure has a high abrasion resistance and durability.

9) When the resinous matrix comprises a PMIA resin, the resultant brush structure has a high heat resistance, a high glass transition temperature, a high rigidity, and a high abrasion resistance.

We claim:

1. A striated flexible sheet material for a brush, provided with a plurality of striae and ridges formed alternately of at least one face of the sheet material and extending in parallel to each other along the longitudinal axis of the sheet material, and comprising (1) a flexible aromatic polyamide resin and (2) abrasive particles dispersed in the flexible aromatic polyamide resin, said striated flexible sheet having a length of 10 to 200 mm, a width of 10 to 2000 mm and a maximum thickness of 0.1 to 5 mm and said striae having a depth corresponding to 20% and 90% of the maximum thickness of the sheet material.

2. The striated flexible sheet material as claimed in claim 1, wherein the abrasive particles are selected from the group consisting of silicon carbide, alumina, diamond, energy, cerium oxide, magnetite and metal particles, having a particle size of 0.1 to 1000 $\mu$m.

3. The striated flexible sheet material as claimed in claim 1, wherein the striae have a width of 0.05 to 10 mm and are arranged at intervals of 0.2 to 50 mm.

4. The striated flexible sheet material as claimed in claim 1, wherein the striae and the ridges are formed symmetrically about the center plane of the sheet on both faces thereof.

5. A brush structure comprising a plurality of striated flexible sheets having a plurality of striae and ridges formed alternately on at least one face of he sheet material and extending in parallel to each other along the longitudinal axis of the sheet material, and comprising (1) a flexible aromatic polyamide resin and (2) abrasive particles evenly distributed in the striated flexible sheet material, said striae having a depth corresponding to 20% to 90% of the maximum thickness of the sheet material, and said striated sheets being arranged in the same direction with respect to the extending direction of the striae and the ridges, and being superposed one on the other and bonded at longitudinal one end portions thereof to each other with a bonding material to thereby provide a block or bundle of the striated sheets.

6. The brush structure as claimed in claim 5, wherein the striated sheet block is bonded at the bonded end portion thereof to a base member.

7. The brush structure as claimed in claim 6, wherein the base member is in the form of a disk.

8. The brush structure as claimed in claim 6, wherein the base member is in the form of one of a cylinder and ring and a plurality of the striated sheet blocks are bonded to the periphery of the thus-shaped base member.

9. The brush structure as claimed in claim 6, wherein the base member is in the form of one of a circular and annular disk, and a plurality of the striated sheet blocks are radially arranged around the center of the disk and bonded thereto.

* * * * *